US009776839B2

(12) United States Patent
Persico et al.

(10) Patent No.: US 9,776,839 B2
(45) Date of Patent: Oct. 3, 2017

(54) CONTROL STATION FOR OPERATING A MACHINE, IN PARTICULAR A WIRELESS, PORTABLE, AND MANUALLY OPERATED REMOTE CONTROL FOR A CRANE

(71) Applicant: Terex MHPS GmbH, Düsseldorf (DE)

(72) Inventors: Giuliano Persico, Wetter (DE); Wolfgang Krebs, Wetter (DE); Stefan Elspass, Tönisvorst (DE)

(73) Assignee: Terex MHPS GmbH, Düsseldorf (DE)

( * ) Notice: Subject to any disclaimer, the term of this patent is extended or adjusted under 35 U.S.C. 154(b) by 0 days.

(21) Appl. No.: 15/022,113

(22) PCT Filed: Sep. 22, 2014

(86) PCT No.: PCT/EP2014/070151
§ 371 (c)(1),
(2) Date: Mar. 15, 2016

(87) PCT Pub. No.: WO2015/044093
PCT Pub. Date: Apr. 2, 2015

(65) Prior Publication Data

US 2016/0236914 A1 Aug. 18, 2016

(30) Foreign Application Priority Data

Sep. 26, 2013 (DE) ..... 10 2013 110 681

(51) Int. Cl.
*B66C 13/40* (2006.01)
*G08C 17/02* (2006.01)

(52) U.S. Cl.
CPC ..... *B66C 13/40* (2013.01); *G08C 17/02* (2013.01)

(58) Field of Classification Search
CPC ..... G08C 17/02; G08C 23/04; B66C 13/40
See application file for complete search history.

(56) References Cited

U.S. PATENT DOCUMENTS 8,350,672 B2 1/2013 Münzebrock
2004/0011154 A1* 1/2004 Dybro ..... E02F 9/2004 74/473.3

(Continued)

FOREIGN PATENT DOCUMENTS

DE 8215903 U1 10/1982
DE 102006012471 A1 9/2007

(Continued)

OTHER PUBLICATIONS

International Search Report and Written Opinion of the International Searching Authority from corresponding Patent Cooperation Treaty (PCT) Application No. PCT/EP2014/070151, dated Sep. 22, 2014.

(Continued)

*Primary Examiner* — Nabil Syed
(74) *Attorney, Agent, or Firm* — Gardner, Linn, Burkhart & Flory, LLP

(57) ABSTRACT

A control switch for operating a machine, the control switch including a housing that includes a gripping region for an operator, and a detecting device for detecting an operator. The control switch further includes a safety circuit for activating the control switch when an operator is detected, and deactivating the control switch when the operator is not detected. The safety circuit includes a detecting device that includes at least one sensor operable to detect in a near field an operator's hand holding the control switch in the gripping region. The detecting device includes at least one additional sensor which detects a use of the control switch.

20 Claims, 4 Drawing Sheets

(56) References Cited

U.S. PATENT DOCUMENTS

| | | | | |
|---|---|---|---|---|
| 2009/0009358 | A1* | 1/2009 | Munzebrock | G08C 17/02 340/9.1 |
| 2009/0126115 | A1* | 5/2009 | Doering | A61G 7/018 5/616 |
| 2009/0243909 | A1* | 10/2009 | Reams | G06F 1/3203 341/173 |
| 2010/0231384 | A1* | 9/2010 | Reams | H04N 5/4403 340/540 |
| 2011/0025345 | A1* | 2/2011 | Unterreitmayer | G06F 1/3231 324/600 |
| 2012/0287350 | A1* | 11/2012 | Song | G03H 1/265 348/734 |

FOREIGN PATENT DOCUMENTS

| | | | |
|---|---|---|---|
| DE | 102009051819 | A1 | 6/2010 |
| DE | 102009057935 | A1 | 6/2011 |

OTHER PUBLICATIONS

English Translation of the International Preliminary Report on Patentability from corresponding Patent Cooperation Treaty Application No. PCT/EP/070151, dated Mar. 29, 2016.

* cited by examiner

CONTROL STATION FOR OPERATING A MACHINE, IN PARTICULAR A WIRELESS, PORTABLE, AND MANUALLY OPERATED REMOTE CONTROL FOR A CRANE

CROSS REFERENCE TO RELATED APPLICATION

The present application claims the priority benefits of International Patent Application No. PCT/EP2014/070151, filed on Sep. 22, 2014, which claims priority of DE 10 2013 110 681.1, filed on Sep. 26, 2013, which are hereby incorporated herein by reference in their entirety.

BACKGROUND OF THE INVENTION

German laid-open document DE 10 2009 051 819 A1 discloses a pendant switch for a crane, the operating elements of which can be activated and deactivated by means of a safety circuit. The safety circuit comprises an RFID reading device, which is arranged in the pendant switch, and an RFID transponder which is worn in the form of an armband by an operating person authorised to operate the crane. The RFID reading device has a signal strength with a small range of about 20 cm to 30 cm. The safety circuit ensures that the operating elements of the pendant switch are only activated and thus the crane also only remains operable for as long as an authorised operating person is located in sufficient proximity to the control switch, i.e. the RFID transponder is in the receiving range of the RFID reading device. As soon as the operating person or his RFID transponder becomes too far removed from the receiving range of the RFID reading device, the operating elements of the pendant switch are deactivated by means of the safety circuit.

Moreover, the web page (www.hbc-radiomatic.com) of HBC-radiomatic GmbH describes under the product name "radiomatic pilot" a wireless control switch for a crane which comprises a micro joystick and an inclination sensor as operating elements. Arranged on the micro joystick is a so-called dead-man's button which has to be pressed by a thumb in order to be able to operate the micro joystick. This is intended to prevent crane functions from being triggered unintentionally. The inclination sensor in the control switch is activated by a release button, which is pressed by an index finger, on the underside of the control switch. As soon as the release button is released, the inclination sensor is deactivated. Lifting or lowering movements and travel movements of a crane trolley can be initiated by means of the inclination sensor.

Furthermore, German laid-open document DE 199 21 349 A1 discloses a dead-man's control for a circular saw. The circular saw comprises a trimming table which can be moved by means of a feed drive. The feed drive can be controlled by means of a rotary handle. In order to prevent the feed drive from running inadvertently or without supervision, the dead-man's control is provided in the form of a capacitive, inductive, mechanical and/or electrical sensor in the region of the rotary handle. This ensures that when an operating person contacts the rotary handle the presence of the operating person is detected, which triggers a release of the feed drive by means of the dead-man's control.

FIELD OF THE INVENTION

The invention relates to a control switch for operating a machine, in particular a remote control for a crane with a safety circuit coupled to a detecting device, where the control is activated by the safety circuit when an operator is detected by the detecting device.

SUMMARY OF THE INVENTION

The invention provides a control switch for operating a crane, in particular a wireless, portable and manually operable remote control, which control switch comprises an improved safety circuit for activating and deactivating the control switch.

This object is achieved by a control switch for operating a crane, in particular a wireless, portable and manually operable remote control.

In accordance with the invention, in the case of a control switch for operating a crane, in particular a wireless, portable and manually operable remote control, comprising a detecting device, by means of which an operator can be detected, and a housing, which has a gripping region for an operator, and a safety circuit, by means of which the control switch can be activated when an operator is detected and can be deactivated when an operator is not detected, an improvement is achieved by virtue of the fact that the detecting device comprises at least one sensor which detects in a near field an operator's hand holding the control switch in the gripping region, and the detecting device comprises at least one further sensor which detects a use of the control switch. As a result, it is possible in an ergonomically advantageous manner to dispense with the use of so-called dead-man's buttons. The at least two sensors together with the safety circuit assume the dead-man's function and continuously detect the presence of the operator's hand in the gripping region of the housing of the control switch or a use of the control switch. This results in an improvement in ergonomic terms because the operator does not actively have to operate a dead-man's button. Moreover, inadvertent interruptions during operation are avoided because the activation of the control switch does not depend upon a dead-man's button being permanently held down, but merely depends on the fact that an operating person is holding the control switch in his hand. Also, the operation of the control switch does not change or is not restricted with respect to known models because the operator is not able to notice the sensors. Furthermore, these sensors are robust and therefore suitable for operating a crane. The use of two sensors increases the probability that only one hand of the operator or one operator using the controller effects the activation.

In terms of the invention, hand-detection could also be effected indirectly in conjunction with a radio solution and a transponder which is located on the hand or body and is to be detected.

Provision may be made that the at least one sensor and the further sensor are connected to a logic circuit which transmits an activation signal to the safety circuit if the near field sensor and the further sensor each detect an operator or detect a use of the control switch. This increases safety in relation to the detection and function of the sensors.

Provision may be made that the near field extends, starting from the gripping region, a maximum of 3 mm, preferably a maximum of 2 mm. This reliably ensures that an unintended operation of the control switch cannot take place. The desired dead-man's function is also achieved by virtue of this very close range.

Provision may be made that the at least one first sensor is arranged in the interior of a housing of the control switch such that an operator's hand holding the control switch can be detected by the sensor. This ensures reliable detection of the operator's hand. The sensors are thus also integrated in the housing and are not noticed by the user and do not hinder the user when operating the control switch.

In order to increase detection reliability and the avoidance of incorrect detection as a result of the control switch being placed down on an object, provision is made that arranged in the interior of the housing is at least one further sensor which is formed as a near-field sensor, acceleration sensor, optical sensor or inclination sensor. The control switch is then activated only if, in addition to the detection by the capacitive sensor, a detection is also effected by the other sensor.

Provision may be made that the second sensor is formed as a near-field sensor and the first sensor and the second sensor are arranged in the housing at a spaced interval with respect to one another. The spacing increases the probability that only one of the operator's hands effects the activation.

Provision may be made that a second near-field sensor and a third near-field sensor are arranged in the interior of the housing of the control switch such that an operator's hand holding the control switch can be detected by the second sensor or the third sensor in addition to the first sensor. Therefore, the control switch can also be placed on an object without an activation being effected.

Provision may be made that the at least one first near-field sensor is a capacitive sensor or a radio sensor.

Provision may be made that the first, second and third sensors are formed as capacitive sensors, each comprise a first, second and third electrode, the first electrode, the second electrode and the third electrode are arranged in the housing at a spaced interval, preferably orthogonally in different spatial planes, with respect to one another. The spacing and optionally the spatial arrangement of the electrodes increases the probability that only one of the operator's hands effects the activation.

In conjunction with a cuboid housing of the control switch, it is advantageous that the first electrode is arranged in the region of an underside of the housing, the second electrode is arranged in the region of a left longitudinal side of the housing and the third electrode is arranged in the region of a right longitudinal side of the housing. This permits both right- and left-handed operation.

In order to actuate the safety circuit, provision may be made that the near-field sensor and the further sensor are connected to a logic circuit which transmits an activation signal to the safety circuit if the near-field sensor and the further sensor each detect an operator.

Alternatively, in order to actuate the safety circuit, provision may be made that the first, second and third sensors are connected to a logic circuit which transmits an activation signal to the safety circuit if the first sensor and one of the second and third sensors each detect an operator.

BRIEF DESCRIPTION OF THE DRAWINGS

The present invention will be explained in greater detail hereinafter with reference to an exemplified embodiment illustrated in the drawing, in which.

DESCRIPTION OF THE PREFERRED EMBODIMENT

Figure 1:
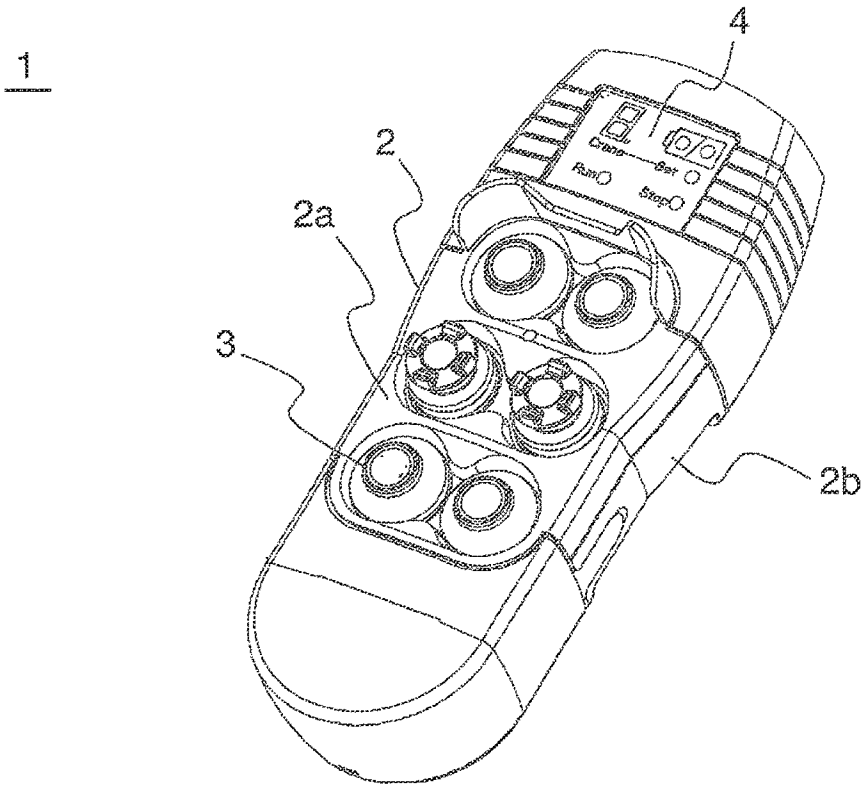
FIG. 1 illustrates a plan view of a control switch in accordance with the invention.

FIG. 1 illustrates a plan view of a wireless control switch 1 in accordance with embodiments of the invention which is formed as a radio-operated and portable hand-held control switch. The control switch 1 typically consists of a substantially cuboid housing 2 having rounded corners, on the upper side 2*a* of which a plurality of operating elements 3 and a display 4 are arranged. The shape and dimensions of the control switch 1 are configured such that the control switch can be gripped effectively at a gripping region 2*f* by an operator's hand 13 (see FIG. 2) and the operating elements 3 can be easily reached and operated by a thumb. The operating elements 3 are formed as a single-level or multi-level button or mini-joystick and typically bear symbols which each correspond to an operating function for a crane. In connection with a control switch 1 for an indoor travelling crane, the symbols illustrate the functions of lifting, lowering, trolley movement to the right, trolley movement to the left, forwards crane travel, rearwards crane travel and freely allocatable special functions such as operating a buzzer. The mini-joysticks are used to control e.g. the travel movements of the crane and trolley. The display 4 is used to display e.g. the charging state of a battery or operating states of the control switch 1. By actuating one of the operating elements 3 of the control switch 1, corresponding control signals are produced for the respective operating function and are transmitted wirelessly to the crane and in this way the respective control procedure is triggered. The housing 2 contains sufficient space to accommodate components, not illustrated, such as a chargeable battery 5, mechanical and electrical parts of the operating elements 3 and a control circuit 6 for generating, processing, transmitting and receiving control signals. The battery 5 and the control circuit 6 are schematically illustrated in FIG. 2.

Figure 2:
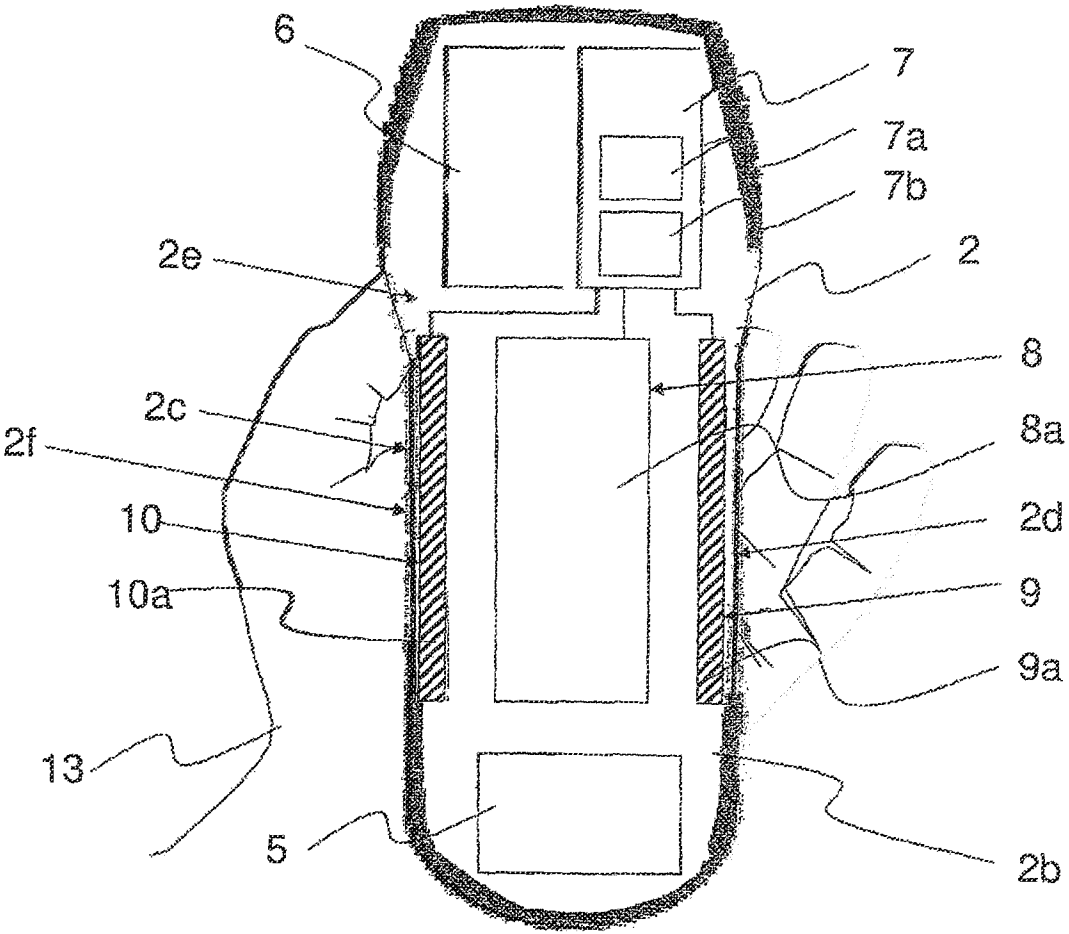
FIG. 2 illustrates a sectional view of the control switch in accordance with FIG. 1.

In addition, a safety circuit 7 illustrated in FIG. 2 is provided in order to avoid unintentional operation of the control switch 1. By means of the safety circuit 7, the control switch 1 can be switched back and forth between a safety state and an operating state depending upon requirement. In the safety state, the operating elements 3—with the exception of the stop button—are deactivated. Therefore, it is not possible for the crane to be inadvertently operated by objects which have been placed or laid onto the control switch 1 or as a result of the control switch 1 falling.

FIG. 2 illustrates a sectional view of the control switch in accordance with FIG. 1. In an aspect of the current invention, the housing 2 consists of an upper part and a lower part, and as illustrated in FIG. 2, the dish-shaped lower part has an underside 2*b*, a left longitudinal side 2*c* and a right longitudinal side 2*d*. In the interior 2*e* of the housing 2, the control circuit 6 and the safety circuit 7 at the upper end of the housing 2 are schematically illustrated in addition to the battery 5 at the lower end of the housing 2. The safety circuit 7 is subdivided into a logic part 7*a* and a monitoring part 7*b*. The monitoring part 7*b* cyclically verifies the correct function of the sensors 8, 9, 10. This monitoring function can also be implemented in the control circuit 6. A first sensor 8, a second sensor 9 and a third sensor 10 are also arranged in the interior 2*e* of the housing 2. Each of the sensors 8, 9 and 10 is formed as a near-field sensor having a near-field range of a maximum of 3 mm, preferably a maximum of 2 mm.

This near-field range is located in the gripping region 2*f* of the control switch 2. By means of such a near-field sensor, an operator's hand 13 can be detected if this hand is located in the near-field range. Near-field sensors can be sensors having capacitive electrodes or radio antennas.

In the present exemplified embodiment, the sensors 8, 9 and 10 are formed as contact-sensitive capacitive sensors which each comprise a flat, plate-shaped and rectangular electrode 8*a*, 9*a* and 10*a* which, as seen in the longitudinal direction L of the housing 2, are arranged in the centre and thus in the gripping region 2*f* of an operator's hand 13 gripping the control switch 1. The electrodes 8*a*, 9*a* and 10*a* are plate-shaped or rod-shaped. The first electrode 8*a* is oriented with its longitudinal extension in the longitudinal direction L of the housing 2 and is arranged on the underside 2*b* of the housing 2 and thus lies opposite the metacarpus of an operator's hand gripping the control switch 1. Typically, when the control switch 1 is being operated it rests with its underside 2*b* in the palm of the operator's hand. In the event that the control switch 1 is held in the hand of a right-handed person, the ball of the thumb of his hand lies externally on the right longitudinal side 2*d* of the control switch 1. The second electrode 9*b* is arranged internally on the right longitudinal side 2*d* and is oriented with its longitudinal extension in the longitudinal direction L of the housing 2. The second electrode 9*b* thus lies opposite the ball of the thumb. The third electrode 10*a* is arranged, opposite the second electrode 9*b*, internally on the left longitudinal side 2*c* of the housing 2 and is likewise oriented with its longitudinal extension in the longitudinal direction L of the housing 2. When a hand is closed, the fingers lie only slightly or not at all from the outside on the left longitudinal side 2*c*, so that they do not lie opposite the third sensor 10. The third sensor 10 is thus used if the control switch 1 is held by a left-handed person because then the ball of the thumb lies on the left longitudinal side 2*c*.

The rectangular electrodes 8*a*, 9*a* and 10*a* are produced from a conductive material, preferably copper or a copper alloy. The capacity required for the electrodes 8*a*, 9*a* and 10*a* depends inter alia upon the size and the position of the electrodes 8*a*, 9*a* and 10*a* in the housing 2, the material of the housing 2 and the electrodes 8*a*, 9*a* and 10*a*. Instead of the plate-shaped or rod-shaped configuration of the electrodes 8*a*, 9*a* and 10*a*, it is also feasible to vapour-deposit them internally onto the housing. In this case, the electrodes 8*a*, 9*a* and 10*a* of the sensors 8, 9 and 10 are designed and arranged within the housing 2 of the control switch 1 in such a manner that any contact on the external side of the housing 2 of the control switch 1 by the sensors 8, 9 and 10 without any direct contact to the electrodes 8*a*, 9*a* and 10*a* thereof results in a detectable change in capacity and thus also in the detection of a hand lying thereon. In this case, it is not significant whether the hand has contact directly with the housing or the operator is wearing a glove. In order to be able to output a corresponding output signal when a hand is detected, the sensors 8, 9 and 10 cooperate with a detection circuit 8*b*, 9*b* and 10*b* (see FIG. 3) which consists in each embodiment substantially of an integrated circuit which switches based on a quiescent value, i.e. capacity of the housing 2 without a hand 13 lying thereon with a predetermined change in capacity and thus provides an output signal. Typically, the sensitivity of the sensors is adjusted by capacitors and resistors which form part of the detection circuit 8*b*, 9*b* and 10*b*. The quiescent value can change in dependence upon ambient conditions. Since a predetermined change in capacity results in an output signal in terms of hand-detection, the associated absolute values are adapted accordingly.

The sensors 8, 9 and 10 cooperate with the safety circuit 7 in order to activate and deactivate the control switch 1 in the manner of a dead-man's control. For this purpose, the detection circuits 8*b*, 9*b* and 10*b* are connected to the safety circuit 7 via first, second and third signal lines 8*c*, 9*c* and 10. In FIG. 2, the detection circuits 8*b*, 9*b* and 10*b* are not illustrated. They can also be arranged together on a circuit board with the safety circuit 7, so that the first, second and third signal lines 8*c*, 9*c* and 10*c* are then strip conductors. The safety circuit 7 or the sensors 8, 9 and 10 detect whether the control switch 1, in particular its underside 2*b* and one of the longitudinal sides 2*c* and 2*d* is in contact with an object which is typically an operator's hand 13. If the operator's hand is detected, the control switch 1 is activated by the safety circuit 7. The control switch 1 remains activated only for as long as a hand lying thereon in this manner is detected. For this purpose, the safety circuit 7 continuously interrogates the state of the sensors 8, 9 and 10. Accordingly, the safety circuit 2 deactivates the control switch 1 if an operator's hand is no longer detected. This deactivation is typically associated with the operating elements 3 being blocked, so that all of the crane functions come to a standstill with the exception of the stop button.

Since the sensors 8, 9 and 10 can detect not only contact by hand but also contact by any material, both electrically conductive and dielectric material, it is necessary to preclude a situation where the control switch 1 is activated by merely lying on e.g. a workbench. Therefore, the first electrode 8*a* is arranged offset by approximately 90 degrees with respect to the second or third electrode 9*a*, 10*a*, so that they do not lie in a common plane of the housing 2 of the control switch 1.

Figure 3:
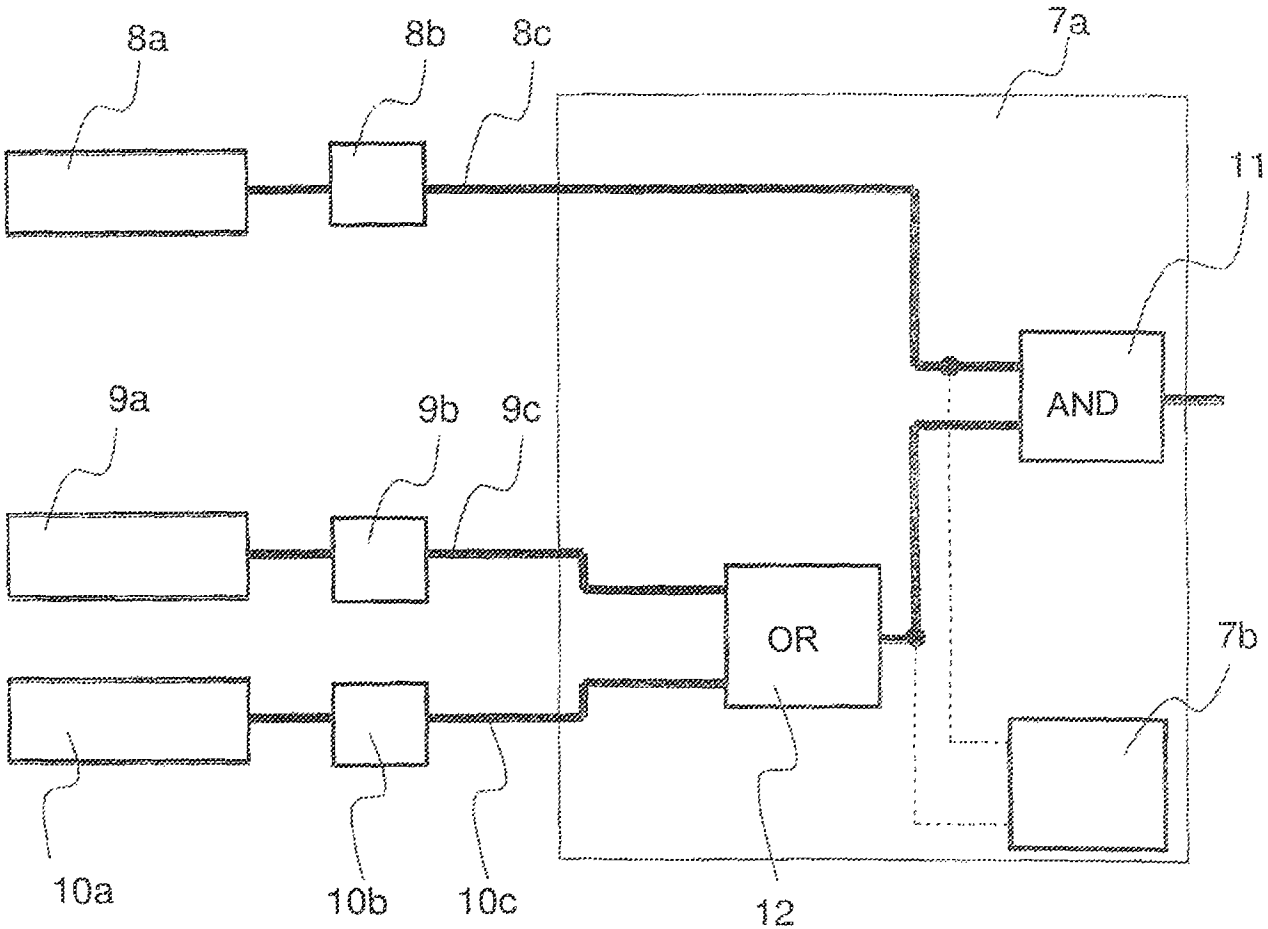
FIG. 3 illustrates a schematic circuit diagram of a logic circuit in a safety circuit of the control switch of FIG. 1 comprising three sensors.

FIG. 3 illustrates a schematic circuit diagram of the logic circuit 7*a* within the safety circuit of the control switch 1. By means of this logic circuit 7*a*, the sensors 8, 9 and 10 are interconnected with their electrodes 8*a*, 9*a* and 10*a* and detection circuits 8*b*, 9*b* and 10*b* with the objective that at least two of the sensors 8, 9 and 10 must enter a detection state in order to activate the control switch 1. In this case, first, second and third signal lines 8*c*, 9*c* and 10*c* of the sensors 8, 9 and 10 are provided on the output side on their detection circuits 8*b*, 9*b* and 10*b*. The logic circuit is formed as a two-channel system, wherein the first electrode 8*a* on the underside 2*b* of the housing 2 is allocated to a first channel and the second and third electrodes 9*a*, 10*a* on the longitudinal sides 2*c*, 2*d* of the housing 2 are allocated to a second channel. The output signals of the first and second channels are linked via an AND gate 11, so that the palm of the hand and the ball of the thumb of the operator have to be detected by the sensors 8, 9 and 10 in order to activate the control switch 1. With respect to right-handed or left-handed operation of the control switch 1, the two opposite sensors 9 and 10 are provided, of which correspondingly in each case only one is detected by the ball of the thumb of the operator. A link is provided via an OR gate 12 in the second channel. Accordingly, the safety circuit 7 activates the control switch 1 only when both channels of the safety circuit 7 detect a hand lying thereon. The output signals of the OR gate 12 and the detection circuit 8*b* are monitored by the monitoring circuit 7*b*. The logic circuit 7*a* and/or the monitoring circuit 7*b* can also be produced by microcomputer technology. In order to produce a redundant, two-channel safety circuit 7, two microcontrollers are then preferably necessary. Both receive the sensor information and compare the respective output signals. The operating elements 3 are unlocked only when the output signals correspond.

Figure 4:
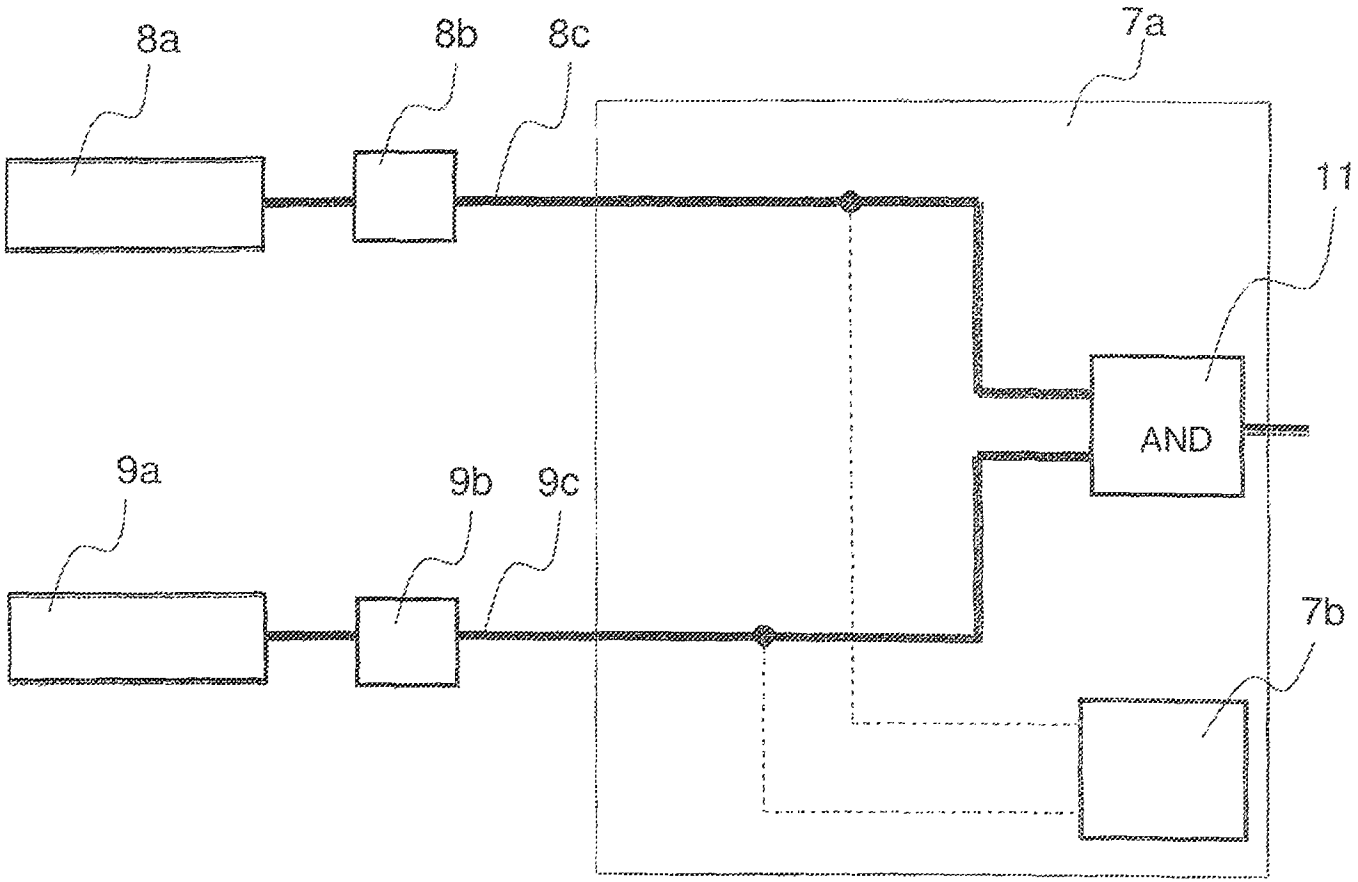
FIG. 4 illustrates a schematic circuit diagram of a logic circuit in a safety circuit of the control switch of FIG. 1 comprising two sensors.

FIG. 4 illustrates a circuit diagram corresponding substantially to the schematic circuit diagram illustrated in FIG. 3, so that reference can be made essentially to the preceding description. The substantial difference resides in the fact that only two sensors 8, 9 are used. The first sensor 8 is formed as a capacitive sensor and the second sensor 9 is formed as an inclination sensor. In this case, two-channel signal processing is also used, wherein, however, the OR gate 12 can be omitted because the inclination sensor operates independently of the operation of the control switch 1 by a right-handed or left-handed person. Accordingly, the output signals of the two detection circuits 8*b* and 9*b* are monitored by the monitoring circuit 7*b*.

An exemplary embodiment of the present invention is described with reference to a radio-operated control switch 1. It is also fundamentally feasible to use the invention in an infrared-operated control switch or other wireless methods for data transmission. Of course, it is alternatively also possible for the control switch 1 to be formed as a conventional pendant control switch and for the control signals to be transmitted via a control line which connects the pendant control switch to the crane. Independently thereof, the present invention permits operation of machines in general, in the event that control switches are used. The sensors 8, 9 and 10 can also be formed as an acceleration sensor, as an optical sensor or as an inclination sensor. These sensors can be arranged at any locations in or on the housing 2 of the control switch 1. From a safety point of view, a combination of different sensor technologies would be preferable, e.g. a capacitive first sensor 8 with only one further inclination sensor which are connected to one another over two channels via an AND gate. Alternatively, the lateral electrodes 9*a* and 10*a* are replaced by portions of EMC-seals which consist substantially of an elastic carrier and an electrically conductive wire mesh. The electrodes 8*a*, 9*a* and 10*a* can also be vapour-deposited or adhered electrodes. These portions then assume in each case the function of a capacitive sensor. Furthermore, in the present exemplified embodiment the near-field sensor is described as a capacitive sensor having an electrode. The near-field sensor can also be formed as a radio sensor having an antenna which is then arranged in the housing in place of the electrode. An RF sensor or radio sensor consists generally of an antenna and an RF module which are both arranged in the housing of the control switch and typically adjacent one another. The RF module has a transmitter with which electrical signals are converted into electromagnetic waves and are transmitted via the antenna. There are also RF modules which can transmit and receive (transceivers). The antenna dimensions are adapted to the frequency of the electromagnetic waves to be transmitted or received or to the wavelength thereof. Arranged in the region of the operator's hand is then a transponder, in particular an RFID transponder, which is then detected. Furthermore, the near-field sensor can also be formed as an IR transmitting diode and an IR receiving diode which are then arranged in the housing in place of the electrodes or radio sensors. In one embodiment, the IR transmitting diode and the IR receiving diode are arranged opposite one another in the manner of a light barrier, so that the IR light path is interrupted by the operator's hand in order to produce the required signal "gripping region held". Alternatively, so-called reflex light barriers can be used: IR transmitters and IR receivers are not arranged opposite one another but rather next to one another. The operator's hand reflects the IR light as it approaches, so that in this case the signal "gripping region held" is produced if the receiver receives the reflected IR light. Base units of the so-called Body-Com-Technology by the company Microchip Technology can also be used as near-field sensors. The Body-Com-Technology uses a bidirectional communication between a base unit which is installed in the housing of the switch and a mobile detection chip which is carried around by the operator on his body or clothing. The signals to be transmitted are transmitted and received capacitively by the base unit and the detection chip, wherein the human body serves as a communication channel. This technology implicitly detects an operator's hand if the communication channel is established. In terms of the invention, this is also understood to include hand-detection. Instead of the Body-Com-Technology, the operator can also carry an RFID transponder close to his thumb.

LIST OF REFERENCE SIGNS

1 control switch
2 housing
2*a* upper side
2*b* underside
2*c* left longitudinal side
2*d* right longitudinal side
2*e* interior
2*f* gripping region
3 operating element
4 display
5 battery
6 control circuit
7 safety circuit
7*a* logic circuit
7*b* monitoring part
8 first sensor
8*a* first sensor electrode
8*b* first detection circuit
8*c* first signal line
9 second sensor
9*a* second sensor electrode
9*b* second detection circuit
9*c* second signal line
10 third sensor
10*a* third sensor electrode
10*c* third signal line
10*b* third detection circuit
11 AND gate
12 OR gate
13 hand

The invention claimed is:

1. A crane assembly comprising:

a crane operable to travel and further operable to lift/lower; and a control switch for operating the crane, wherein the control switch comprises:

a housing, which has a gripping region for an operator, a detecting device for detecting an operator, and a safety circuit for activating the control switch when an operator is detected;

wherein the detecting device comprises a first sensor which detects in a near field an operator's hand holding the control switch in the gripping region, and wherein the detecting device comprises a second sensor which detects a use of the control switch, and wherein a first electrode of the first sensor is arranged in a region of an underside of the housing, wherein the underside of the housing is opposite an upperside of the housing, and wherein operating elements are arranged on the upperside of the housing; and wherein the safety circuit comprises a monitoring circuit and a logic circuit, wherein both the monitoring circuit and the logic circuit are responsive to the first sensor and the second sensor, wherein the safety circuit transmits an activation signal if the first sensor and the second sensor each detect an operator or detect a use of the control switch, respectively, as determined by the logic circuit and verified by the monitoring circuit, and wherein the activation signal is only transmitted when signals received by the logic circuit and the monitoring circuit correspond.

2. The crane assembly as claimed in claim 1, wherein the near field extends, starting from the gripping region, a maximum of 3 mm, and preferably a maximum of 2 mm.

3. The crane assembly as claimed in claim 1, wherein the first electrode of the first sensor is arranged in the interior of the housing of the control switch such that an operator's hand holding the control switch is detected by the first sensor.

4. The crane assembly as claimed in claim 3, wherein the second sensor is arranged in the interior of the housing, and wherein the second sensor is formed as one of a near-field sensor, an acceleration sensor, an optical sensor, and an inclination sensor.

5. The crane assembly as claimed in claim 4, wherein the second sensor is formed as a near-field sensor, and wherein the first sensor and the second sensor are arranged in the housing at a spaced interval with respect to one another.

6. The crane assembly as claimed in claim 3, wherein the detecting device further comprises a third sensor, and wherein the second sensor and the third sensor are each formed as near-field sensors and are arranged in the interior of the housing of the control switch such that an operator's hand holding the control switch can be detected by the second sensor or the third sensor in addition to the first sensor.

7. The crane assembly as claimed in claim 6, wherein the first near-field sensor is a capacitive sensor or a radio sensor.

8. The crane assembly as claimed in claim 7, wherein the first, second and third sensors are formed as capacitive sensors, each comprising an electrode, and wherein the first electrode of the first sensor, a second electrode of the second sensor and a third electrode of the third sensor are arranged in the housing at a spaced interval with respect to one another.

9. The crane assembly as claimed in claim 8, wherein the second electrode is arranged in a region of a left longitudinal side of the housing, and the third electrode is arranged in a region of a right longitudinal side of the housing, and wherein the second electrode and the third electrode are arranged on opposite sides of the first electrode.

10. The crane assembly as claimed in claim 9, wherein the first, second and third sensors are connected to said logic circuit which transmits said activation signal to the safety circuit if the first sensor and one of the second and third sensors each detect said operator.

11. A crane assembly comprising:

a crane operable to travel and further operable to lift/lower; and a control switch for operating the crane, the control switch comprising:

a housing which has a gripping region for an operator, a detecting device for detecting an operator, and a safety circuit for activating the control switch when an operator is detected;

wherein the detecting device comprises a plurality of sensors which detect in respective near fields an operator's hand holding the control switch in the gripping region, and wherein a first electrode of a first sensor of the plurality of sensors is arranged in a region of an underside of the housing, wherein the underside of the housing is opposite an upperside of the housing, and wherein operating elements are arranged on the upperside of the housing; and wherein the safety circuit comprises a monitoring circuit and a logic circuit, wherein both the monitoring circuit and the logic circuit are responsive to each of the plurality of sensors, wherein the safety circuit transmits an activation signal if each of the plurality of sensors detects an operator, as determined by the logic circuit and verified by the monitoring circuit, and wherein the activation signal is only transmitted when signals received by the logic circuit and the monitoring circuit correspond.

12. The crane assembly as claimed in claim 11, wherein the plurality of sensors are arranged in the interior of a housing of the control switch such that an operator's hand holding the control switch is detected by the plurality of sensors.

13. The crane assembly as claimed in claim 12, wherein the plurality of sensors are arranged in the housing at a spaced interval with respect to one another.

14. The crane assembly as claimed in claim 11, wherein each of the near fields extend, starting from the gripping region, a maximum of 3 mm, and preferably a maximum of 2 mm.

15. The crane assembly as claimed in claim 11, wherein the first near field sensor of the plurality of sensors comprises one of a capacitive sensor and a radio sensor.

16. The crane assembly as claimed in claim 12, wherein the plurality of sensors are each formed as capacitive sensors, with each comprising a respective electrode, and wherein the respective electrodes are arranged in the housing at a spaced interval with respect to one another.

17. The crane assembly as claimed in claim 16, wherein a second electrode of a second sensor of the plurality of sensors is arranged in the region of a left longitudinal side of the housing, and a third electrode of a third sensor of the plurality of sensors is arranged in the region of a right longitudinal side of the housing, and wherein the second electrode and the third electrode are arranged on opposite sides of the first electrode.

18. The crane assembly as claimed in claim 17, wherein the first, second, and third sensors are connected to said logic circuit which transmits said activation signal to the safety circuit if the first sensor and one of the second and third sensors each detect said operator.

19. The crane assembly as claimed in claim 1, wherein the first electrode of the first sensor is arranged as a rectangular plate in a region of the underside of the housing, wherein the underside of the housing is opposite an upperside of the housing.

20. The crane assembly as claimed in claim 11, wherein the first electrode of the first sensor of the plurality of sensors is arranged as rectangular plate in a region of the underside of the housing, wherein the underside of the housing is opposite an upperside of the housing.

* * * * *